United States Patent [19]

Ikenaga

[11] Patent Number: 5,031,423

[45] Date of Patent: Jul. 16, 1991

[54] PATTERN CONTROL DEVICE FOR FLAT KNITTING MACHINES

[75] Inventor: Katsuyoshi Ikenaga, Arita, Japan

[73] Assignee: Ikenaga Co., Ltd., Arita, Japan

[21] Appl. No.: 475,967

[22] Filed: Feb. 6, 1990

[30] Foreign Application Priority Data

Jan. 6, 1989 [JP] Japan ..... 1-735[U]
Aug. 31, 1989 [JP] Japan ..... 1-225863

[51] Int. Cl.[5] ..... D04B 7/24
[52] U.S. Cl. ..... 66/126 R
[58] Field of Search ..... 66/126 R, 126 A

[56] References Cited

U.S. PATENT DOCUMENTS 3,650,127 3/1972 Niestroj et al. ..... 66/126 R
3,673,819 7/1972 Swanwick et al. ..... 66/126 R
4,321,807 3/1982 Strong ..... 66/126 R
4,640,103 2/1987 Schieber .
4,658,603 4/1987 Stoll et al. ..... 66/126 R
4,724,685 2/1988 Stoll et al. .

FOREIGN PATENT DOCUMENTS 44-12212 5/1969 Japan .
56-140141 11/1981 Japan .
322392 1/1985 Japan ..... 66/126 R
61-51061 11/1986 Japan .
62-50589 10/1987 Japan .

*Primary Examiner*—Werner H. Schroeder
*Assistant Examiner*—John J. Calvert
*Attorney, Agent, or Firm*—Fleit, Jacobson, Cohn, Price, Holman & Stern

[57] ABSTRACT

A pattern control device for flat knitting machines including knitting needle control carriages (2) adapted to be moved laterally along carriage guide rails (8) by a driving motor (5) via a toothed resilient belt (10), a plurality of yarn guide support plates (13) which retain yarn guide supports (18) provided with feeders (12) in such a manner than the yarn guide supports (18) can be vertically moved, and which are provided so that the yarn guide supporting plates (13) can be moved laterally along yarn guide supporting plate guide rails (14) by their respective guide driving motors (22) via toothed resilient belts (16*a*, 15*b*), and a control unit is used to control the yarn guide supporting plates (13) provided with yarn guides (3) for supporting yarn required for a knitting operation selectively in concurrence with the movements of the carriages (2).

6 Claims, 10 Drawing Sheets

PATTERN CONTROL DEVICE FOR FLAT KNITTING MACHINES

BACKGROUND OF THE INVENTION

1. Field of the Invention

This invention relates to a pattern control device for flat knitting machines, which is made so that the controlling of the movements of yarn guides can be done accurately.

2. Description of the Prior Art

As shown in FIGS. 8–11, a conventional flat knitting machine consists of a pair of needle beds 51 arranged so as to have an inverse V section, a pair of carriages 52 which contain cams (not shown) for moving up and down the needles on the needle beds, and which are adapted to be moved back and forth in the lateral direction, a plurality of yarn guides 53 adapted to be moved with the carriage and feed yarn to the needles, and a ledge 54 on which wound knitting yarn is set up. The opposed carriages 52 are connected together by a saddle 66, and yarn guide operating pins 67 project downward from a horizontal portion of the saddle.

As shown in FIGS. 10 and 11, each of the yarn guides 53 constituting a principal portion of a pattern mechanism and provided with yarn feeders 65 at the lower ends thereof is fixed to a horizontal guide rail 55, which extends along a needle bed 51, via a yarn guide box 56 provided at the upper portion of the yarn guide 53, in such a manner that the yarn guide 53 can slide laterally (refer to the directions of arrows in FIG. 10), and the yarn guide box 56 is provided with a recess 60 in the upper surface thereof.

During a knitting operation, the yarn guide operating pin 67 extending downward from the saddle 66 engages the recess 60 suitably in accordance with a pattern, and the relative yarn guide is moved in accordance with a lateral movement of the carriage 52. The amount of movement of the yarn guide is determined depending upon the distance between opposed left and right yarn guide stoppers 61. Each of the yarn guide stoppers 61 is connected via a movable bar 59 to a female screw member 62 which can be displaced laterally by a horizontally extending elongated parent screw 58 engaged therewith and provided in a yarn guide operating member 57 (refer to FIG. 8) fixed on a frame so as to extend leftward. The amount of movement of this yarn guide stopper can be regulated laterally to a suitable extent along the horizontal guide rail 55 in the same manner as the yarn guide box 56.

When a yarn guide operating pin 67 on the carriage 52 collides with a cam portion 61*a* at the free end of a stopper 61, it is lifted along a cam surface thereof to disengage from the recess 60 in the yarn guide box 56, so that the yarn guide operating pin 67 is released from the yarn guide box 56, as is clearly understood from FIGS. 10 and 11. Accordingly, even when the carriage 52 is moved, the yarn guide box 56 is left stopped in contact with the yarn guide stopper 61. The parent screw 58 is adapted to be turned forward and backward suitably by a geared motor 64 connected directly thereto, in accordance with an instruction from an electronic controller (refer to FIG. 8) set on a side portion of a machine base.

In the above-described conventional pattern mechanism for a flat knitting machine, a yarn guide stopper 61 which collides with a yarn guide box 56 springs back in some cases due to the shock of collision. Consequently, an error occurs in a knitted pattern, so that the boundary lines between different color portions in the pattern become irregular. Moreover, it becomes necessary to provide a waiting time during an operation of transferring the yarn guide stoppers sequentially in accordance with the pattern, and a stop time occurs in the machine base. This causes the productive efficiency to lower. In addition, it is difficult to provide a large number of yarn guides in a narrow space.

BRIEF SUMMARY OF THE INVENTION

The present invention has been developed so as to solve these problems of a prior art pattern control device of this kind. An object of the present invention is to provide a pattern control device for flat knitting machines capable of moving yarn guides smoothly, obtaining an accurate knitted pattern, and carrying out a knitting operation with a high efficiency by using many different color yarns without causing a knitting operation stopping period to occur.

The above object of the present invention is achieved by the following structures:

(1) A pattern control device for flat knitting machines, comprising knitting needle control carriages 2 adapted to be moved laterally along carriage guide rails 8 by a driving motor 5 via a toothed resilient belt 10, a plurality of yarn guide supporting plates 13 which retain yarn guide supports 18 provided with feeders 12, in such a manner that the yarn guide supports can be vertically moved, and which are provided so that the yarn guide supporting plates can be moved laterally along yarn guide supporting plate guide rails 14 by their respective yarn guide driving motors 22 via toothed resilient belts 16, and a control unit 6 for the yarn guide driving motors 22, which control unit 6 is used to control the yarn guide supporting plates 13, which are provided with yarn guides 3 for supplying yarn required for a knitting operation, selectively in concurrence with the movements of the carriages 2.

(2) A pattern control device for flat knitting machines according to (1) above, wherein each of the yarn guide supporting guide rails 14 is formed so as to have a channel section or an I section, the yarn guide supporting plates 13, which are guided by the upper and lower surfaces of the guide rails 14, being formed so as to be moved laterally by toothed resilient belts 16*a*, 16*b* which are inserted in grooves 14*a* in the guide rails 14 and wrapped around pulleys at both end portions of the guide rails 14, the toothed belts being formed so that the toothed belts can be moved independently of each other and synchronously with the movements of the carriages 2.

According to the pattern devices thus constructed for flat knitting machines, yarn guide stoppers can be omitted, and it becomes possible to move the yarn guides sequentially by a predetermined amount by rotating the yarn guide driving servomotors 22 in order by an amount, which corresponds to a predetermined pulse, in accordance with the speed of the carriage 2, in compliance with an instruction from the electronic control unit and with reference to the positions of the carriages which are being moved by the rotation of carriage driving servomotors. Therefore, it is unnecessary to provide a waiting time between the yarn guides. Moreover, when, for example, a 100-pulse signal is used with respect to a travelling distance of 1 mm of the carriages and yarn guides, a very accurate pattern having substantially no errors is obtained. It also becomes possible to provide two yarn guides on one surface of one guide rail, and this enables a larger number of knitting yarn to be used.

BRIEF DESCRIPTION OF THE DRAWINGS

The above and other objects as well as advantageous features of the invention will become apparent from the following description of the preferred embodiment the following description of the preferred embodiment taken in conjunction with the accompanying drawings wherein:

FIGS. 8–11 show a conventional example of the flat knitting machine, wherein:

FIG. 8 is a front elevation,

FIG. 9 is a side elevation,

FIG. 10 is a front elevation schematically showing the construction of a yarn guide driving mechanism, and FIG. 11 is a perspective view of a part of what is shown in FIG. 10.

DETAILED DESCRIPTION

Figure 1:
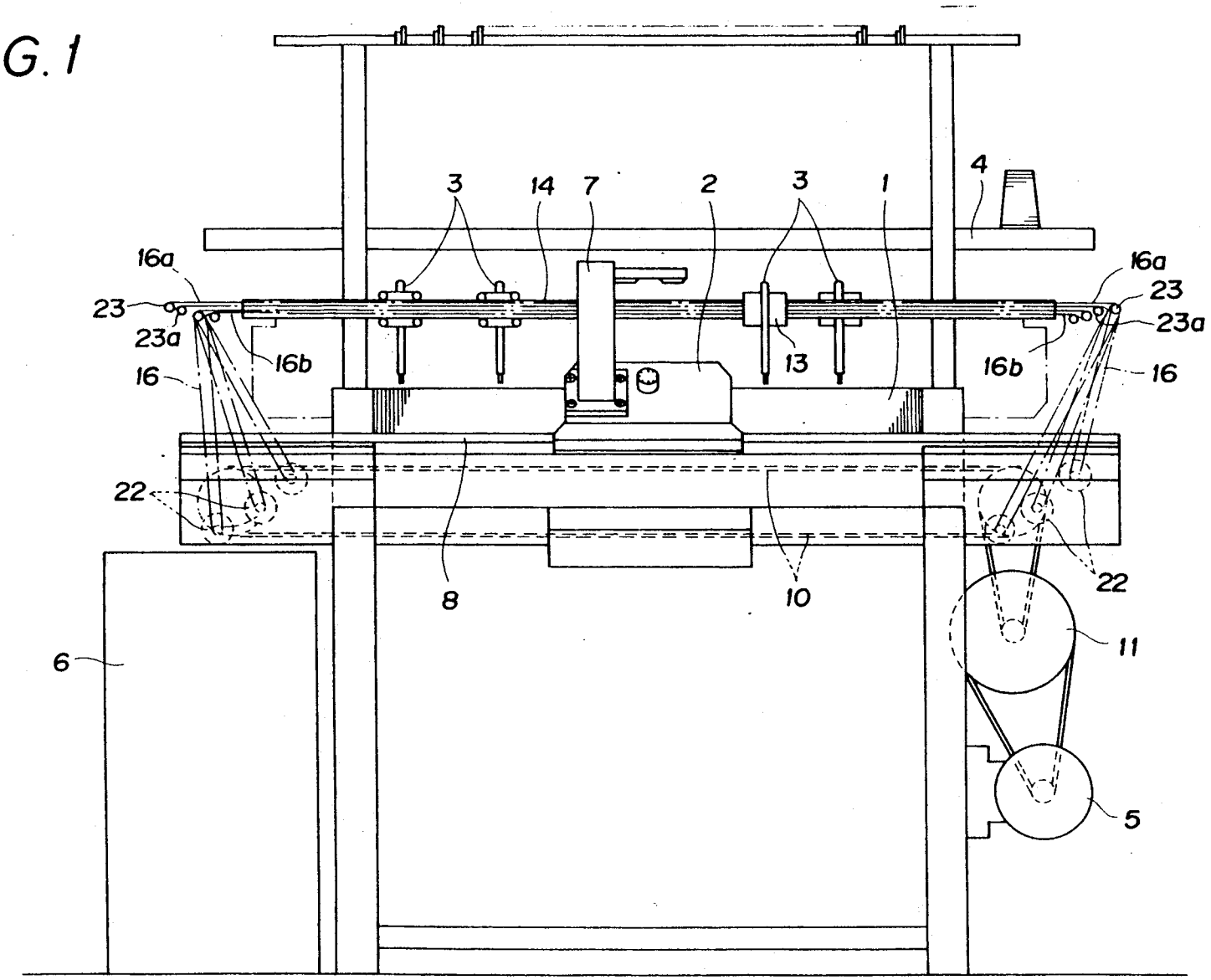
FIG. 1 is a front elevation of a flat knitting machine to which the present invention is applied.
Figure 2:
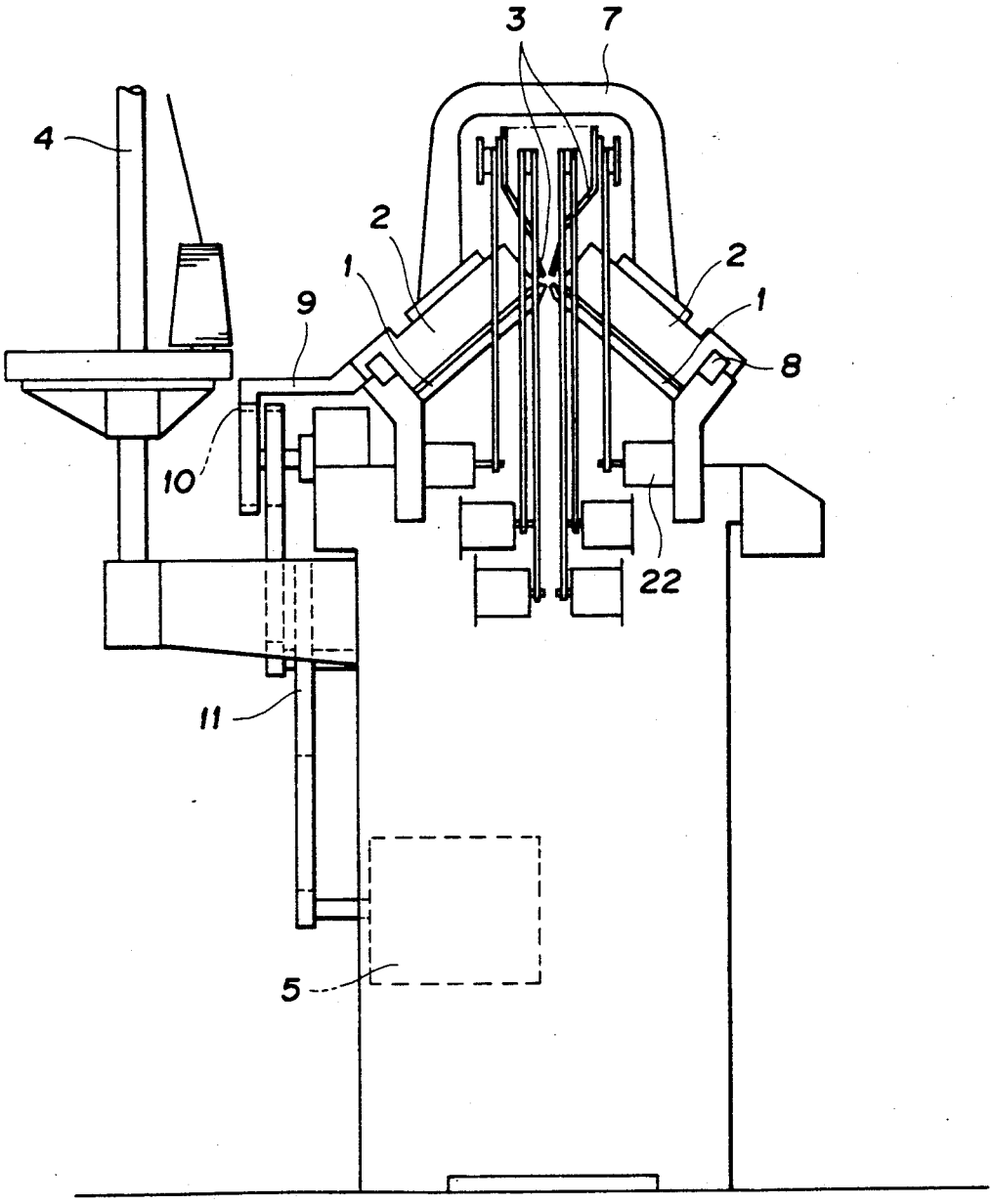
FIG. 2 is a side elevation of the knitting machine.

As shown in FIGS. 1 and 2, the flat knitting machine consists of principal parts, such as a pair of needle beds 1 arranged so as to have an inverse V section, a pair of carriages 2 which contain cams for moving up and down the needles on the needle beds, and which are adapted to be moved back and forth in the lateral direction, a plurality of yarn guides 3 adapted to be moved with the carriage 2 and feed knitting yarn to the needles, and a ledge 4 on which wound knitting yarn is set up, the carriages 2 being driven by a driving servomotor 5 provided on the right side portion of a frame, on the left side portion of which an electronic pattern control unit 6 is provided.

Figure 3:
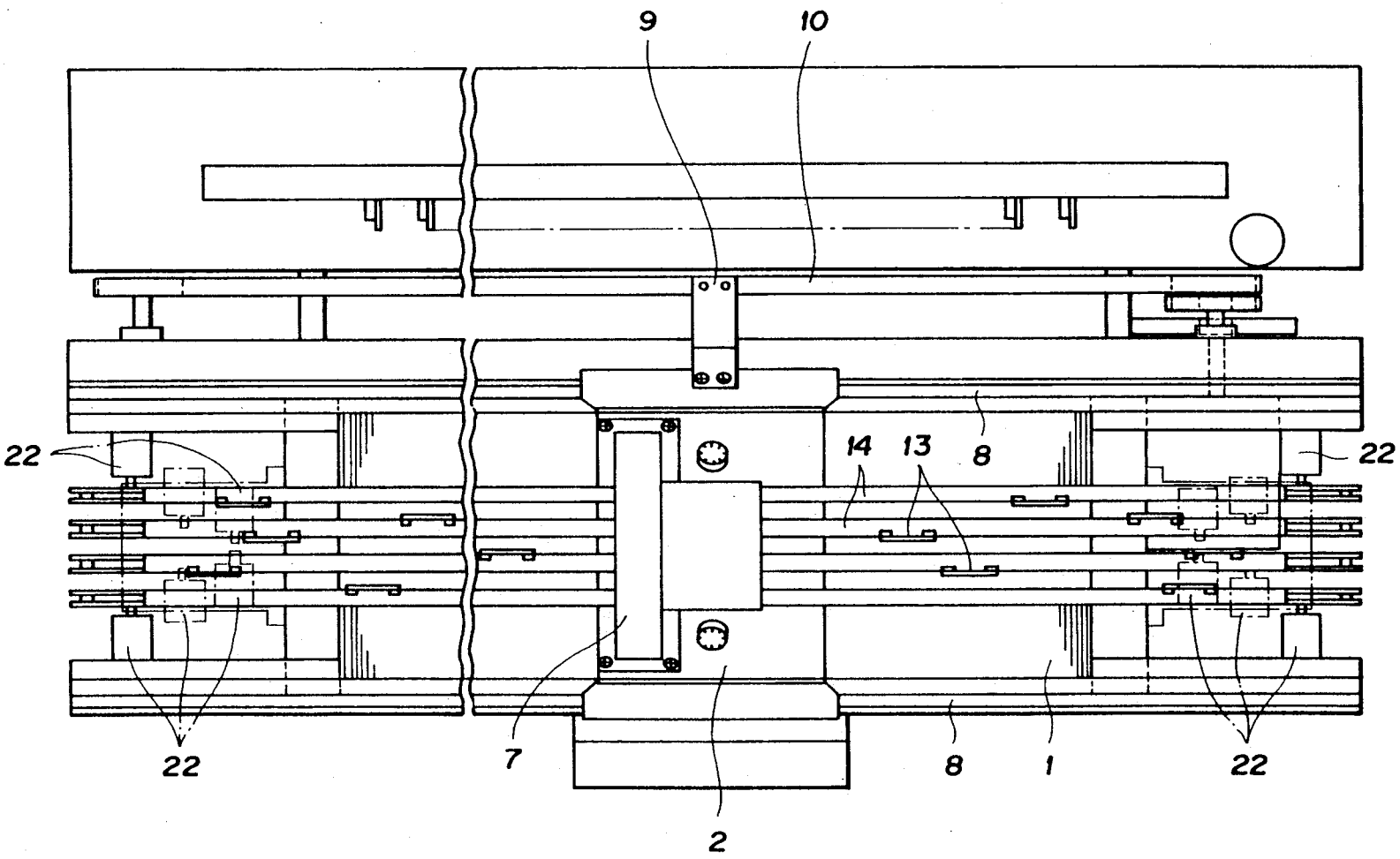
FIG. 3 is a top plan view of a principal portion of the knitting machine.

The two carriages 2 are connected together by a reverse U-shaped connecting member 7 and placed slidably on horizontally extending guide rails 8, the carriages 2 being fixed to an endless annular tooth-carrying belt 10 via a metal connecting member 9 (refer to FIGS. 2 and 3). A two-step speed reducing toothed pulley 11 is provided between the toothed belt 10 and servomotor 5.

Figure 4:
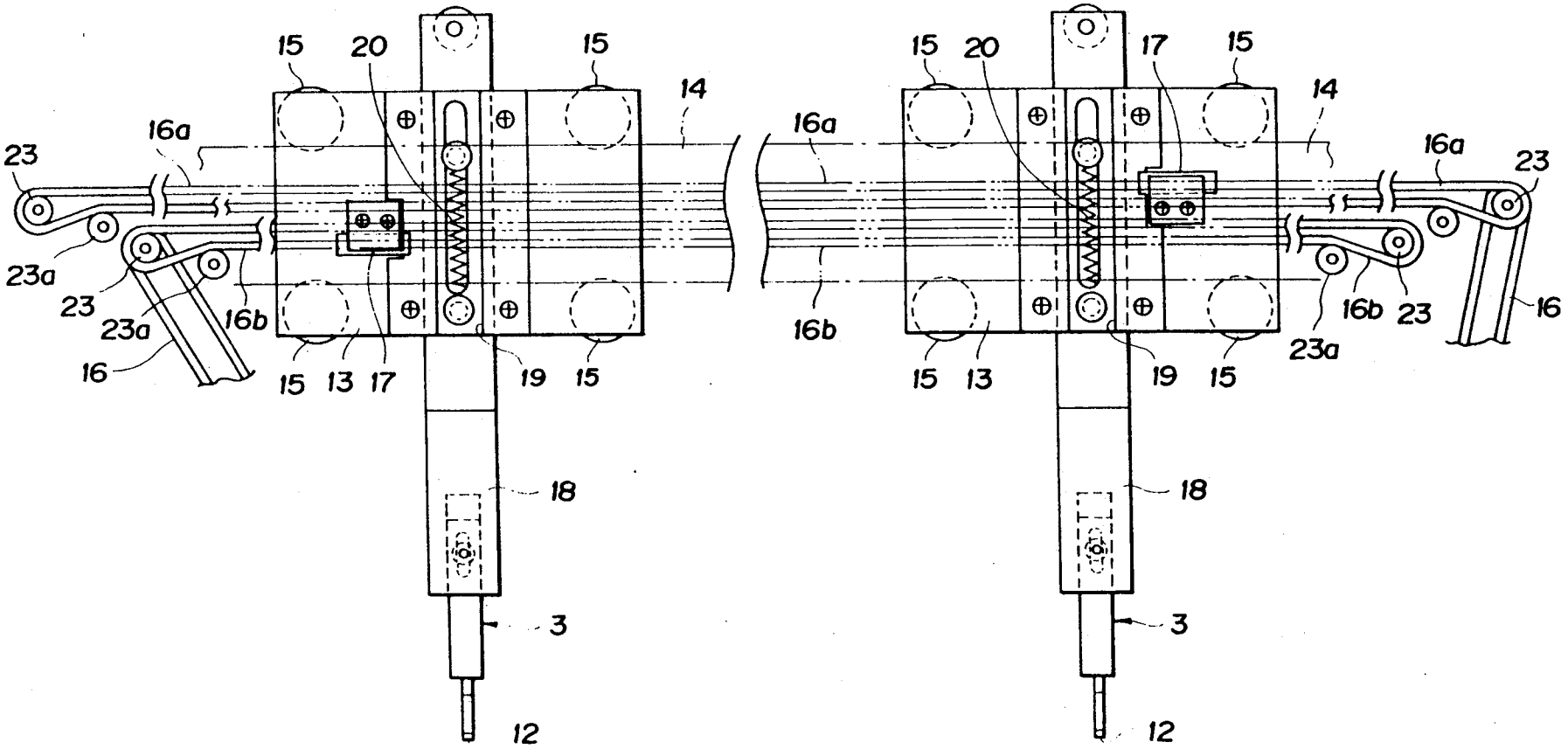
FIG. 4 is a front elevation of yarn guides and a driving mechanism therefor in the knitting machine.
Figure 5:
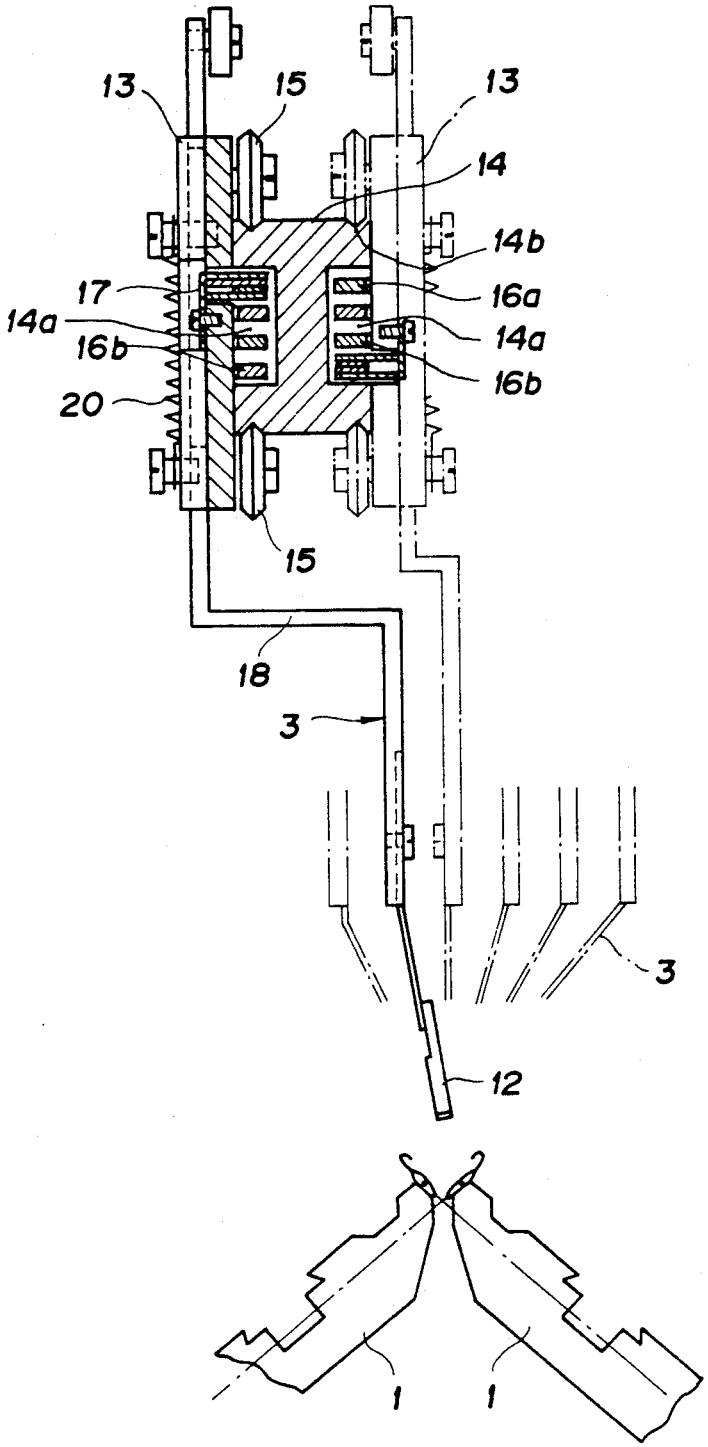
FIG. 5 is a vertical cross-sectional view through a yarn guide supporting plate shown in FIG. 4.

A pattern mechanism will now be described. As shown in FIGS. 4 and 5, each yarn guide 3 is provided with a feeder 12 at the free end portion thereof and supported on a yarn guide supporting plate 13 via a yarn guide support 18 so that the yarn guide 3 can slide vertically. Two yarn guide supporting plates 13 are fitted in the left and right surfaces of an I section guide rail 14 so that the yarn guide supporting plates 13 can be moved slidingly in the lengthwise direction thereof via their respective pair of rollers 15, and these yarn guide supporting plates 13 are fixed via metal fasteners 17 to the endless annular tooth-carrying belts **16*a* provided in the laterally elongated grooves 14*a* in the guide rails 14. A reference numeral 14*b* denotes grooves with which the rollers 15** are engaged.

The bent plate type yarn guide support 18 extending just above the yarn guide 3 is inserted in a central vertical groove 19 in the yarn guide supporting plate 13, and an upward resilient force is applied constantly to the yarn guide support 18 by a coiled spring 20. The yarn guide support 18 is thus rendered slightly movable in the vertical direction by a cam provided in the relative carriage, in such a manner that the knitting yarn can be supplied from the feeders 12 in accordance with an object pattern without causing the yarn to slip off the needles.

Each endless annular tooth-carrying belt **16*a* in the relative elongated groove 14*a* is supported on pulleys 23, 23 at the left and right end portions thereof and driven independently by the relative yarn guide driving servomotor 22**.

As shown in, especially, FIG. 4, auxiliary pressure rollers **23*a*, 23*a* are provided to press the relative belt 16*a* in such a manner that the distance between the upper and lower belt portions is reduced. This enables a pair of belts 16*a*, 16*b* to be arranged in a laterally elongated groove 14*a* in the guide rail 14, and two yarn guides 3 to be provided on one side of the guide rail 14. A C section guide rail having a laterally elongated groove in one side surface only thereof may be used instead of the I section guide rail shown in FIG. 5**.

A plurality of yarn guide driving servomotors 22 are provided on the left and right portions of a machine base frame so that the servomotors face each other, and the number of the servomotors is set suitably in accordance with that of the pattern yarn so that the servomotors transmit power to the toothed belts **16*a*, 16*b* via the relative toothed belts 16**.

Figure 6:
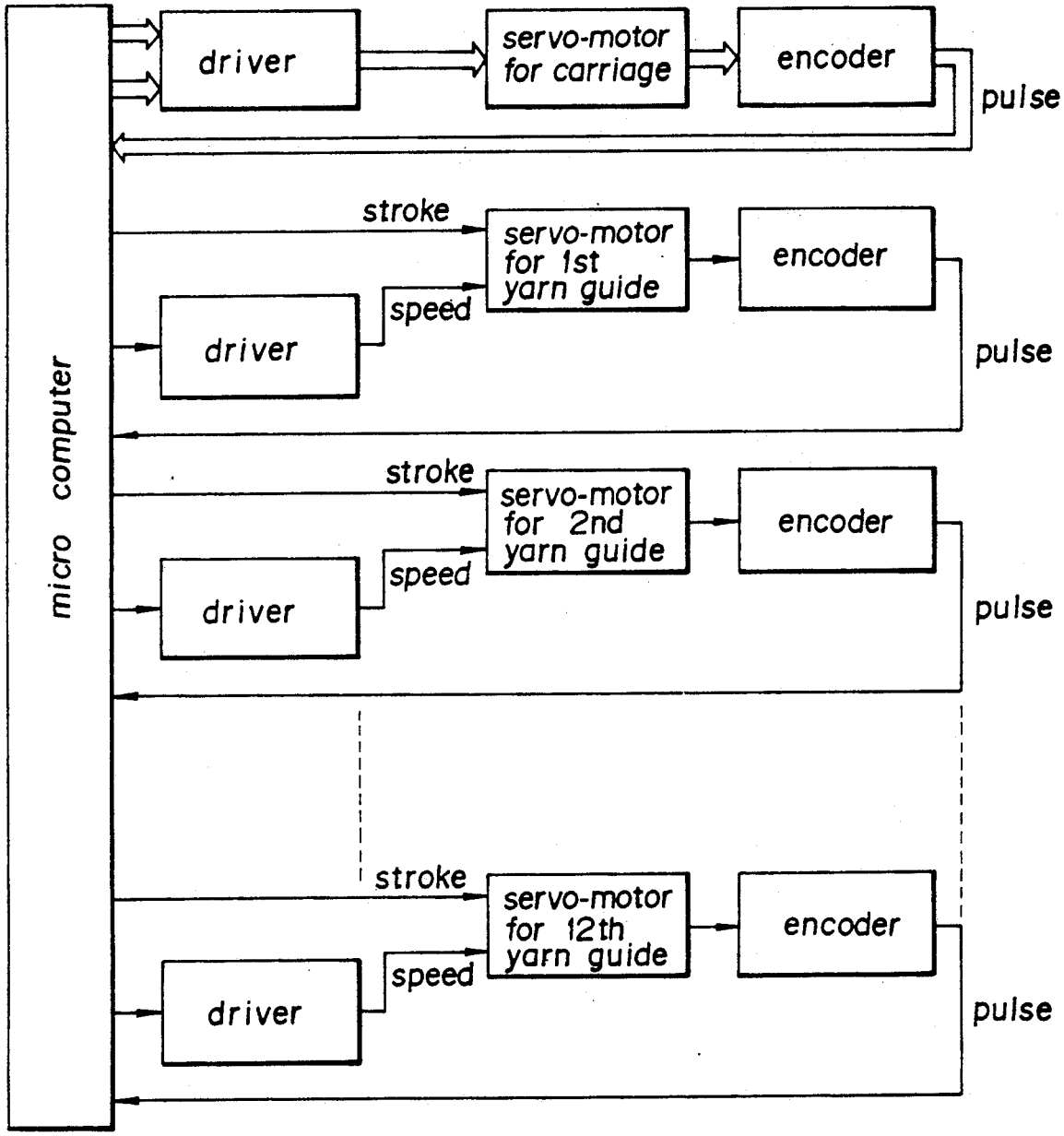
FIGS. 6 and 7 are movement system diagrams of carriages and yarn guides in the knitting machine.
Figure 7:
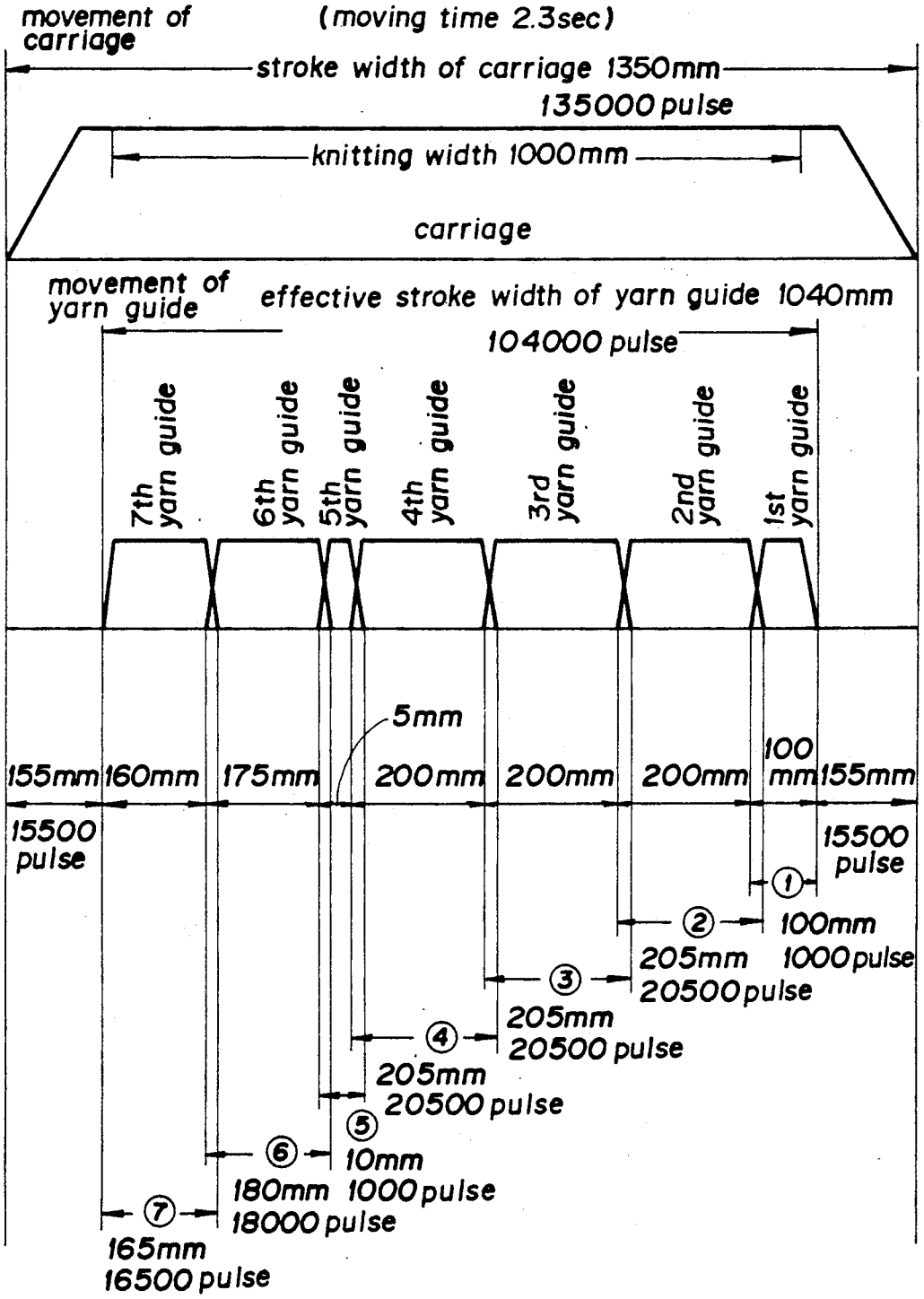
Figure 8:
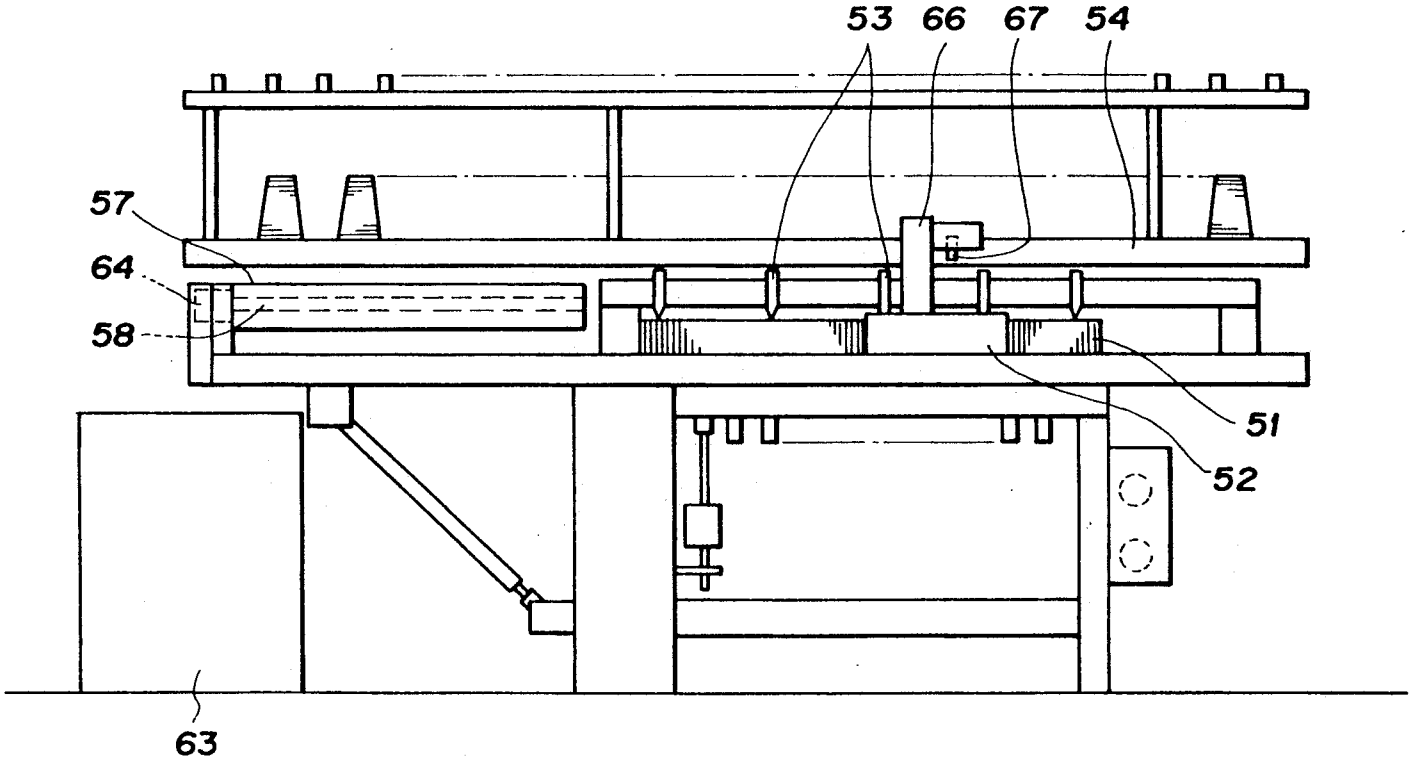
FIG. 8 (PRIOR ART)
Figure 9:
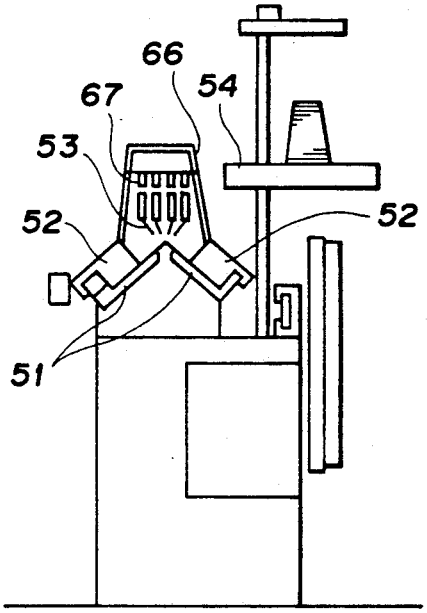
FIG. 9 (PRIOR ART)

The operation of the pattern mechanism will now be described on the basis of what is shown in FIGS. 6 and 7.

A cassette tape or a floppy disk on which the data on a pattern to be knitted are registered is set in a microcomputer, i.e. an electronic control unit, and the carriage driving servomotors are rotated through drivers in accordance with an instruction from the control unit. Thus, the carriages are moved back and forth over a space of a width of, for example 1350 mm in 2–3 seconds to knit a product of 1000 mm in width. A signal of 10 pulses (135,000 pulses with respect to one complete stroke) with respect to the amount of movement of 1 mm of the carriages is outputted from the encoders attached to the carriage driving servomotors to the microcomputer to determine the positions of the carriages in motion very accurately.

The microcomputer sends out an instruction on the basis of the positional data and the data from the cassette tape or floppy disk to rotate such a number of yarn guide driving servomotors out of, for example, twelve yarn guide driving servomotors that corresponds to required pulses, through their respective drivers, and move the yarn guides in order by a required distance at a speed equal to that of the carriages, whereby a knitted cloth having a required pattern can be obtained. Each yarn guide driving servomotor is adapted to transmit a pulse to the microcomputer through the encoder in accordance with the rotation thereof to inform the microcomputer of the position of the yarn guide.

FIG. 7 is a diagram of an inter-sheer pattern knitting operation using, for example, seven yarn guides. The diagram shows that a first yarn guide is moved 100 mm with a second yarn guide then moved 200 mm, the yarn guides being moved sequentially to knit a desired pattern, the adjacent yarn guides crossing each other by 5 mm (one stitch) to form a complete boundary line.

The carriage driving servomotors and yarn guide driving servomotors consists of synchronous motors, which are adapted to generate 100 pulses per 1 mm movement of the carriages and yarn guides to precisely position these parts, and which enable a continuous knitting operation to be carried out, and a very accurate pattern having perfect color yarn boundary lines to be obtained.

Figure 12:
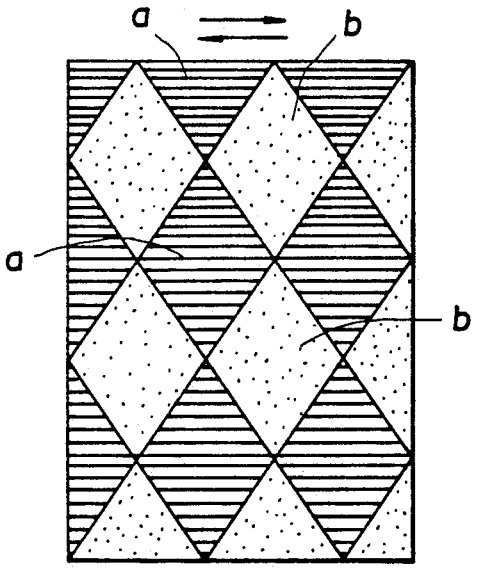
FIGS. 12 and 13 are plan views showing intersheer patterns.
Figure 13:
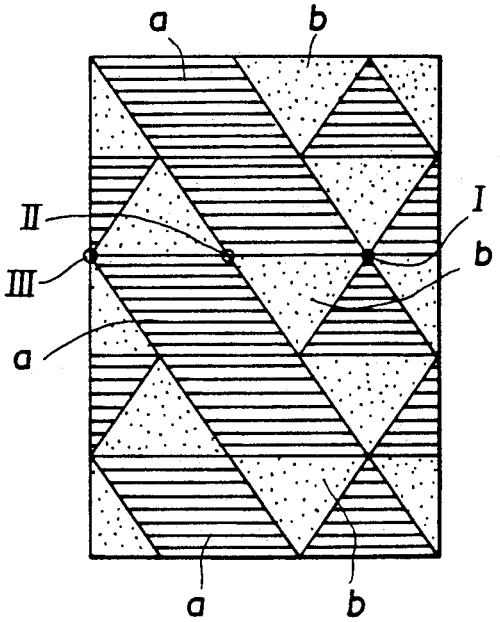
Figure 10:
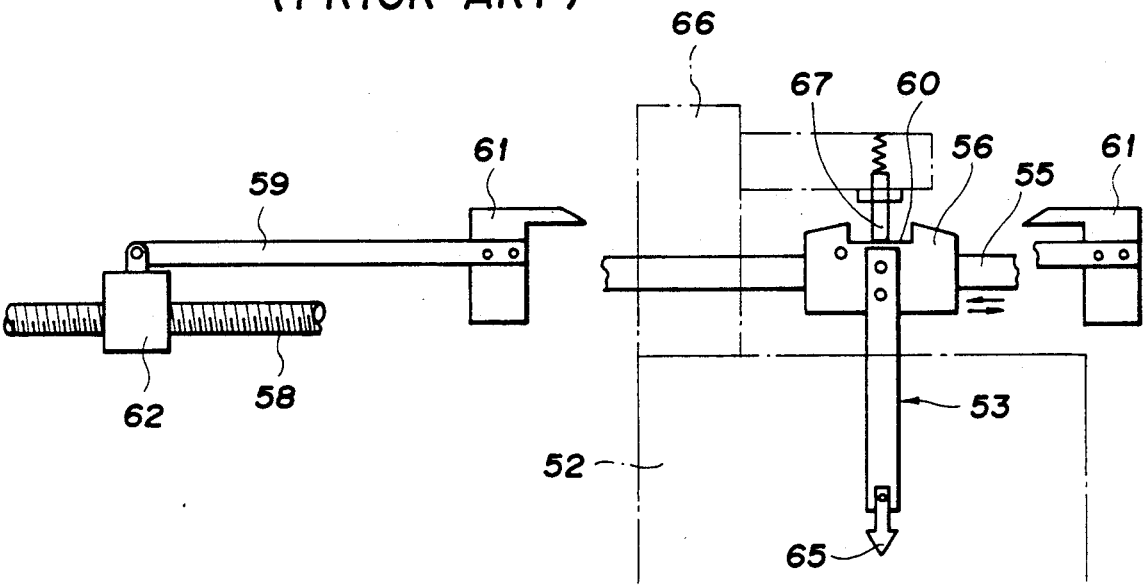
FIG. 10 (PRIOR ART)
Figure 11:
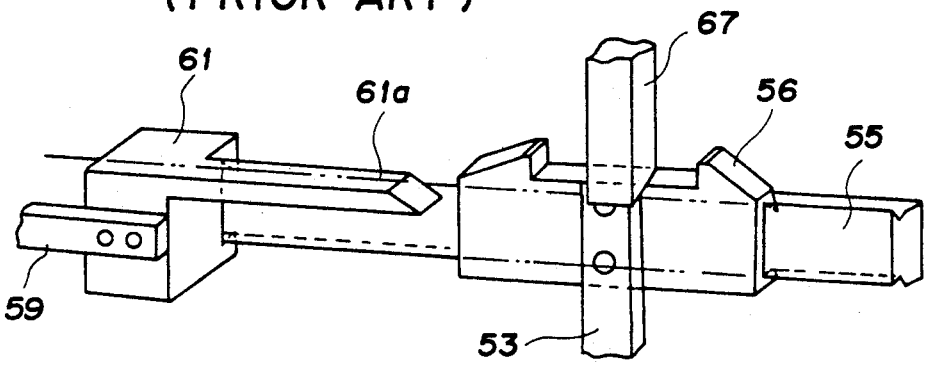
FIG. 11 (PRIOR ART)

In an operation of knitting an inter-sheer pattern where color yarn a and b are changed in knitting operation as shown in FIG. 12 and FIG. 13, for example, in FIG. 13, the yarn guides are required to be moved laterally to a large extent such as to I→II→III at a time, the machine base is stopped temporarily in a conventional pattern mechanism in which a parent screw rod is turned to move a wave guide stopper. In the pattern mechanism according to the present invention in which the movements of the yarn guides can be made arbitrarily by the yarn guide driving servomotors independently of the movements of the carriages, a knitting operation can be carried out continuously, and the productive efficiency of a knitted cloth of a certain pattern can be substantially doubly improved. Since a parent screw rod is not provided on the left side portion of the frame, the construction of the knitting machine becomes simpler, and the total length thereof can be reduced to about ⅔ of a knitting machine employing a conventional pattern control device. This enables the factory site to be effectively utilized.

In the device according to the present invention, the carriages and yarn guides are fixed to the endless annular tooth-carrying belts and driven by synchronous servomotors, and these servomotors are controlled by the electronic control unit. This device is capable of moving the yarn guides accurately and independently of the movements of the carriages, and, especially, control the movements of the yarn guides with respect to the knitting needles with a very high accuracy. This enables perfect inter-sheer patterns to be knitted. Moreover, since the changing of the yarn guides is done with no waiting time, the productive efficiency is improved greatly. Since the toothed belts for moving the yarn guide supporting plates are provided in the grooves in the yarn guide supporting plate guide rails, the pattern control device can be made compact, and two toothed belts can be provided as necessary in each of the grooves. In addition, the width of the knitting machine can be reduced, so that the area of installation thereof can be minimized.

The present invention is not, of course, limited to the above embodiment; it may be modified in various ways within the scope of the appended claims.

I claim:

1. A pattern control device for flat knitting machines, comprising:

carriage guide rails;

a plurality of knitting needle control carriages supported on said carriage guide rails for lateral movement along said guide rails;

a toothed resilient carriage belt means engaging said control carriages for moving said carriages along said guide rails;

a carriage drive motor operatively connected to said carriage belt means for driving said carriage belt means;

yarn guide supporting plate guide rails having an I shaped cross section, upper and lower surfaces, and end portions;

two oppositely facing grooves in each yarn guide supporting plate guide rail;

a plurality of yarn guide supporting plates supported and guided on said upper and lower surfaces of said yarn guide supporting plate guide rails for lateral movement therealong;

a plurality of belt pulleys mounted at both end portions of said yarn guide supporting plate guide rails;

a plurality of toothed resilient yarn guide belts movable in at least one of said grooves and engaging with said yarn guide supporting plates and engaging around said pulleys for independent movement with respect to each other;

separate yarn guide drive motors operatively engaging respective yarn guide belts for driving said yarn guide belts independently and synchronously with the movements of said carriages;

yarn guide supports mounted on said yarn guide supporting plates for vertical movement;

feeders and yarn guides on said yarn guide supports for supplying yarn required for a knitting operation; and a control unit for controlling said yarn guide drive motors to control movement of said yarn guide belts and supporting plates.

2. A pattern control device as claimed in claim 1 wherein:

said yarn guide belts are disposed movably in both oppositely facing grooves.

3. A pattern control device as claimed in claim 1 and further comprising:

pressure rollers engaging each yarn guide belt at both end portions of each yarn guide supporting plate guide rail between respective belt pulleys and adjacent end portions of the respective yarn guide supporting plate guide rail for reducing the distance between oppositely running portions of the respective yarn guide belt.

4. A pattern control device as claimed in claim 1 wherein:

a yarn guide belt is provided in each upper and lower portion of each groove;

first yarn guide supporting plates are attached to said yarn guide belt in said upper portion of each groove; and second yarn guide supporting plates are attached to said yarn guide belt in said lower portion of each groove;

so that said yarn guide supporting plates are moved independently of each other on the same yarn guide support plate guide rail by said respective yarn guide belts.

5. A pattern control device for flat knitting machines, comprising:

carriage guide rails;

a plurality of knitting needle control carriages supported on said carriage guide rails for lateral movement along said guide rails;

a toothed resilient carriage belt means engaging said control carriages for moving said carriages along said guide rails;

a carriage drive motor operatively connected to said carriage belt means for driving said carriage belt means;

yarn guide supporting plate guide rails having a channel shaped cross section, upper and lower surfaces, and end portions;

a groove in each yarn guide supporting plate guide rail;

a plurality of yarn guide supporting plates supported and guided on said upper and lower surfaces of said yarn guide supporting plate guide rails for lateral movement therealong;

a plurality of belt pulleys mounted at both end portions of said yarn guide supporting plate guide rails;

a pluralilty of toothed resilient yarn guide belts movable in said groove and engaging with said yarn guide supporting plates and engaging around said pulleys for independent movement with respect to each other;

separate yarn guide drive motors operatively engaging respective yarn guide belts for driving said yarn guide belts independently and synchronously with the movements of said carriages;

yarn guide supports mounted on said yarn guide supporting plates for vertical movement;

feeders and yarn guides on said yarn guide supports for supplying yarn required for a knitting operation; and a control unit for controlling said yarn guide drive motors to control movement of said yarn guide belts and supporting plates.

6. A pattern control device as claimed in claim 5 and further comprising:

pressure rollers engaging each yarn guide belt at both end portions of each yarn guide supporting plate guide rail between respective belt pulleys and adjacent end portions of the respective yarn guide supporting plate guide rail for reducing the distance between oppositely running portions of the respective yarn guide belt.

* * * * *